US006528458B1

(12) United States Patent
Tagliamonte et al.

(10) Patent No.: US 6,528,458 B1
(45) Date of Patent: Mar. 4, 2003

(54) LUBRICANT FOR DUAL CLUTCH TRANSMISSION

(75) Inventors: Thomas A. Tagliamonte, Mentor, OH (US); Craig D. Tipton, Perry, OH (US); William C. Ward, Jr., Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/126,364

(22) Filed: Apr. 19, 2002

(51) Int. Cl.[7] ..... C10M 14/06
(52) U.S. Cl. ..... 508/185; 508/273
(58) Field of Search ..... 508/185, 273

(56) References Cited

U.S. PATENT DOCUMENTS

| | | | | | |
|---|---|---|---|---|---|
| 3,933,657 | A | * | 1/1976 | Seni et al. | 508/131 |
| 4,136,043 | A | | 1/1979 | Davis | 252/47.5 |
| 4,140,643 | A | | 2/1979 | Davis | 252/47.5 |
| 4,188,299 | A | | 2/1980 | Caspari | 252/46.4 |
| 4,193,882 | A | | 3/1980 | Gemmill, Jr. | 252/47.5 |
| 4,301,019 | A | | 11/1981 | Horodysky | 252/49.6 |
| 4,612,129 | A | | 9/1986 | DiBiase et al. | 252/33.6 |
| 4,792,410 | A | | 12/1988 | Schwind et al. | 252/38 |
| 4,990,273 | A | | 2/1991 | Croudace | 252/46.4 |
| 5,051,198 | A | * | 9/1991 | Salomon | 508/570 |
| 5,422,023 | A | | 6/1995 | Francisco | 252/47 |
| 5,656,577 | A | * | 8/1997 | Kato et al. | 508/210 |
| 5,845,546 | A | | 12/1998 | Knowles et al. | 74/650 |
| 5,915,512 | A | | 6/1999 | Adamis et al. | 192/3.61 |
| 6,044,931 | A | | 4/2000 | Reed, Jr. et al. | 184/6.12 |
| 6,103,673 | A | | 8/2000 | Sumiejski et al. | 508/186 |
| 6,232,275 | B1 | | 5/2001 | Ichihashi et al. | 508/192 |
| 6,251,840 | B1 | | 6/2001 | Ward et al. | 508/162 |
| 6,444,622 | B1 | * | 9/2002 | Balasubramaniam | 508/187 |
| 6,451,745 | B1 | * | 9/2002 | Ward | 508/192 |

FOREIGN PATENT DOCUMENTS

| | | |
|---|---|---|
| EP | 0 601 266 A1 | 6/1993 |
| EP | 0 622 444 A1 | 11/1994 |
| EP | 0 630 960 A1 | 12/1994 |
| EP | 1 052 421 A1 | 11/2000 |
| EP | 1239021 A2 | 9/2002 |

OTHER PUBLICATIONS

"Transmission Options," in Automotive Engineering International, Jul., 2001, pp. 67–68.

* cited by examiner

*Primary Examiner*—Jacqueline V. Howard
(74) *Attorney, Agent, or Firm*—David M. Shold; Michael F. Esposito

(57) ABSTRACT

Compositions comprising (a) an oil of lubricating viscosity; (b) 2,5-dimercapto-1,3,4-thiadiazole (DMTD), a derivative of DMTD, or mixtures thereof; (c) a friction modifier; and (d) a dispersant, are useful for lubricating a transmission having a plurality of wet clutches and a plurality of partial power transmission shafts, wherein shifting of gears occurs by a process comprising synchronization of an engaged and a non-engaged partial transmission shaft and engagement of a wet clutch.

22 Claims, No Drawings

LUBRICANT FOR DUAL CLUTCH TRANSMISSION

BACKGROUND OF THE INVENTION

The present invention relates to a lubricant and a method for lubricating a transmission having a plurality of wet clutches and a plurality of partial power transmission shafts, all elements being lubricated by a common fluid, that is, in a dual clutch transmission.

Dual clutch transmissions, also known as double clutch or twin clutch transmissions, of a variety of types are known. For example, "Transmission Options," in *Automotive Engineering International,* July, 2001, discusses on pages 67–68 double-clutch transmissions and certain of their limitations. Double clutch transmission are known with either dry or wet clutches, the latter having hydrodynamic torque converters.

European publication EP 1 052 421 A, Nov. 15, 2000, discloses a multiple clutch system for a transmission, with two multi-disk clutches that are coaxial with each other, and each clutch is assigned to one of two shafts. The two clutches are arranged in a sealed chamber which contains lubricating oil.

U.S. Pat. No. 6,251,840, Ward et al., Jun. 26, 2001, priority Sep. 12, 1995, equivalent to EP 761 805 A, Mar. 12, 1997, discloses lubricating compositions for use in automatic transmission fluids, tractor hydraulic fluids, manual transmission fluids, continuously variable transmission fluids, wet brake and wet clutch fluids, hydraulic fluids and the like. The compositions embody sulfur and boron-containing components as well as antifoam agents in an oil of lubricating viscosity. Included in the oil of lubricating viscosity is 0.025–5 weight percent on an oil-free basis based on the weight of the lubricating composition of 2,5-dimercapto-1,3,4-thiadiazole (DMTD) or derivatives thereof. The compositions reduce wear in the device in which they are used.

U.S. Pat. No. 4,136,043, Davis, Jan. 23, 1979, discloses compositions which form homogeneous blends with lubricating oils and the like, produced by preparing a mixture of an oil-soluble dispersant (preferably a substantially neutral or acidic carboxylic dispersant) and a dimercaptothiadiazole, and heating the mixture above about 100° C. The additive is useful for the inhibition of copper activity and "lead paint" deposition in lubricants. Automatic transmission fluids, transaxle lubricants and other lubricating oil and grease compositions can benefit from the incorporation of the disclosed invention.

U.S. Pat. No. 6,232,275 B, Ichihashi et al., May 15, 2001, filed Nov. 24, 1999, discloses a lubricating oil composition for automatic transmissions which comprises a base oil, a non-boron based succinic acid imide and a boron based succinic acid imide, a condensation product of a branched chain fatty acid and an amine, and a dialkyl hydrogen phosphite, and optionally at least one member selected from viscosity index improvers, antioxidants, metal deactivators, defoaming agents, detergents, extreme pressure agents, and rust preventive. In examples, one of the other additives is a thiadiazole compound.

U.S. Pat. No. 6,103,673, Sumiejski et al., Aug. 15, 2000, discloses compositions for continuously variable transmissions, comprising an oil of lubricating viscosity, a shear stable viscosity modifier, an overbased metal salt, a phosphorus compound, and a combination of at least two friction modifiers. At least one of the friction modifiers is selected from zinc salts of fatty acids, hydrocarbyl imidazolines, and borated epoxides. Optional materials include dispersants, of which amine dispersants, a mixture of borated, non-reacted, and species reacted with $CS_2$, are disclosed.

The present invention, therefore, solves the problem of fulfilling the requirements of smooth and efficient lubrication of a dual clutch transmission ("DCT"). A single lubricant, as described herein, simultaneously satisfies the multiple requirements of such a transmission, including lubrication of gearing, typical of a manual transmission, and lubrication of gear synchronizers, also typical of a manual transmission, while also lubricating the wet clutch component, that is, a slipping start-up clutch, which is typical of an automatic transmission with all the challenging requirements associated therewith. In particular, the gears of the DCT require pitting protection; the synchronizers require a fluid that provides good durability of shifting as well as having the proper friction curve parameters; and the two start-up clutches for the two parallel input shafts contaiing the gears require proper lubrication.

SUMMARY OF THE INVENTION

The present invention provides a method for lubricating a transmission having a plurality of wet clutches and a plurality of partial power transmission shafts, wherein shifting of gears occurs by a process comprising synchronization of an engaged and a non-engaged partial transmission shaft and engagement of a wet clutch; said method comprising supplying to said transmission a lubricating composition comprising: (a) an oil of lubricating viscosity; (b) 2,5-dimercapto-1,3,4-thiadiazole (DMTD), a derivative of DMTD, or mixtures thereof; (c) a friction modifier other than a species of (b); and (d) a dispersant other than a species of (b).

The present invention also provides a composition suitable for lubricating a transmission having a plurality of wet clutches and a plurality of partial power transmission shafts, comprising or prepared by mixing: (a) an oil of lubricating viscosity; (b) a reaction product of 2,5-dimercapto-1,3,4-thiadiazole and a nitrogen-containing dispersant; (c) a friction modifier which is a condensation product of a $C_6$ to $C_{24}$ aliphatic carboxylic acid and a polyalkylenepolyamine; and (d) a phosphorus compound.

DETAILED DESCRIPTION OF THE INVENTION

Various preferred features and embodiments will be described below by way of non-limiting illustration.

The lubricating compositions useful in the present invention are based on diverse oils of lubricating viscosity, including natural and synthetic lubricating oils and mixtures thereof. The oil of lubricating viscosity is generally present in a major amount (i.e. an amount greater than about 50 percent by weight). Typically, the oil of lubricating viscosity is present in an amount of 75 to 95 percent by weight, and often greater than about 80 percent by weight of the composition.

Natural oils useful in making the inventive lubricants and functional fluids include animal oils and vegetable oils as well as mineral lubricating oils such as liquid petroleum oils and solvent treated or acid-treated mineral lubricating oils of the paraffinic, naphthenic or mixed paraffinic/naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalpha olefins; polyphenyls; alkylated diphenyl ethers; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from $C_5$ to $C_{12}$ monocarboxylic acids and polyols or polyol ethers. Other synthetic oils include silicon-based oils, liquid esters of phosphorus-containing acids, and polymeric tetrahydrofurans.

Unrefined, refined and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is a Group II or a Group III oil, or a synthetic oil, or mixtures thereof. Group II and Group III oils are classifications established by the API Base Oil Interchangeability Guidelines. Both Group II and Group III oils contain ≦0.03 percent sulfur and ≧99 percent saturates. Group II oils have a viscosity index of 80 to 120, and Group III oils have a viscosity index ≧120. Polyalphaolefins are categorized as Group IV.

In a preferred embodiment, at least 50% by weight of the oil of lubricating viscosity is a polyalphaolefin (PAO). Typically, the polyalphaolefins are derived from monomers having from about 4 to about 30, or from about 4 to about 20, or from about 6 to about 16 carbon atoms. Examples of useful PAOs include those derived from 1-decene. These PAOs may have a viscosity from about 2 to about 150 $mm^2/s$ (cSt) at 100° C.

The oils of the present invention can encompass oils of a single viscosity range or a mixture of high viscosity and low viscosity range oils. In a preferred embodiment, the oil exhibits a 100° C. kinematic viscosity of 1 or 2 to 8 or 10 $mm^2/sec$ (cSt). The overall lubricant composition is preferably formulated using oil and other components such that the viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), preferably less than 10 Pa-s, even 5 or less.

Included in the oil of lubricating viscosity in the present invention is an effective amount, on an oil-free basis based on the weight of the lubricating composition of 2,5-dimercapto-1,3,4-thiadiazole (DMTD) or derivatives thereof. Preferred amounts are 0.01 to 15 weight percent, 0.02 to 10, 0.05 to 5, and 0.1 to 3 weight percent.

Derivatives of DMTD include:

(a) 2-hydrocarbyldithio-5-mercapto-1,3,4-thiadiazole or 2,5-bis-(hydrocarbyldithio)-1,3,4-thiadiazole and mixtures thereof;

(b) carboxylic esters of DMTD;

(c)condensation products of α-halogenated aliphatic monocarboxylic acids with DMTD;

(d) reaction products of unsaturated cyclic hydrocarbons and unsaturated ketones with DMTD;

(e) reaction products of an aldehyde and a diaryl amine with DMTD;

(f) amine salts of DMTD;

(g) dithiocarbamate derivatives of DMTD;

(h) reaction products of an aldehyde, and an alcohol or aromatic hydroxy compound, and DMTD;

(i) reaction products of an aldehyde, a mercaptan and DMTD;

(j) 2-hydrocarbylthio-5-mercapto-1,3,4-thiadiazole; and (k) products from combining an oil soluble dispersant with DMTD; and mixtures thereof.

Compositions a)–k) are described in U.S. Pat. No. 4,612,129 and patent references cited therein.

Some preferred thiadiazoles for use in this invention are those listed in a), h), and k) above. 2,5-bis-(hydrocarbyldithio)-1,3,4-thiadiazole and its monosubstituted equivalent 2-hydrocarbylthio-5-mercapto-1,3,4-thiadiazole are commercially available as a mixture of the two compounds in a ratio of about 85 percent bis-hydrocarbyl to 15 percent monohydrocarbyl from the Ethyl Corporation as Hitec™ 4313.

U.S. Pat. Nos. 2,719,125; 2,719,126; and 3,087,937 describe the preparation of various 2,5-bis(hydrocarbyl dithio)-1,3,4-thiadiazoles, that is, wherein each hydrocarbyl group can be linked to the thiadiazole through multiple (e.g., 2) sulfur atoms. The hydrocarbon group may be aliphatic or aromatic, including cyclic, alicyclic, aralkyl, aryl and alkaryl. Such compositions are effective corrosion-inhibitors for silver, copper, silver alloys and similar metals. Such polysulfides which can be represented by the following general formula:

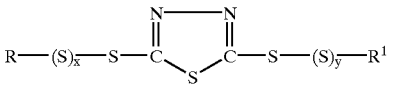

wherein R and $R^1$ may be the same or different hydrocarbon groups, and x and y be integers from 0 to about 8, and the sum of x and y being at least 1. A process for preparing such derivatives is described in U.S. Pat. No. 2,191,125 and comprising the reaction of DMTD with a suitable sulfenyl chloride or by reacting the dimercapto thiadiazole with chlorine and reacting the resulting disulfenyl chloride with a primary or tertiary mercaptan. In another procedure, DMTD is chlorinated to form the desired bissulfenyl chloride which is then reacted with at least one mercaptan (RSH and/or $R^1SH$). U.S. Pat. No. 3,087,932 describes a one-step process for preparing 2,5-bis(hydrocarbyldithio)-1,3,4-thiadiazole. Compositions prepared in this manner are described in U.S. Pat. No. 2,749,311. It will be understood by those skilled in the art that the reactions referenced and described above may produce some amounts of the monohydrocarbyldithio-thiadiazole as well as the bis-hydrocarbyl compounds. The ratio of the two can be adjusted by varying the amounts of the reactants.

The preparation of 2-hydrocarbyldithio-5-mercapto-1,3,4-thiadiazoles having the formula

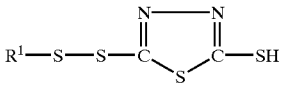

where $R^1$ is a hydrocarbyl substituent, is described in U.S. Pat. No. 3,663,561. The compositions are prepared by the oxidative coupling of equimolecular portions of a hydrocarbyl mercaptan and DMTD or its alkali metal mercaptide. The compositions are reported to be excellent sulfur scavengers and are useful in preventing copper corrosion by active sulfur. The mono-mercaptans used in the preparation of the compounds are represented by the formula $R^1SH$ wherein $R^1$ is a hydrocarbyl group containing from 1 to about 28 carbon atoms. A peroxy compound, hypohalide, or air, or mixtures thereof, can be utilized to promote the oxidative coupling. Specific examples of the mono-mercaptan include methyl mercaptan, isopropyl mercaptan, hexyl mercaptan, decyl mercaptan, and long chain alkyl mercaptans, for example, mercaptans derived from propene polymers and isobutylene polymers especially polyisobutylenes, having 3 to about 70 propene or isobutylene units per molecule.

U.S. Pat. No. 2,850,453 describes products which are obtained by reacting DMTD, an aldehyde, and an alcohol or an aromatic hydroxy compound in a molar ratio of 1:2:1 to 1:6:5. The aldehyde employed can be an aliphatic aldehyde containing 1 to 20 carbon atoms or an aromatic or heterocyclic aldehyde containing 5 to 30 carbon atoms. Examples of suitable aldehydes include formaldehyde, acetaldehyde, benzaldehyde. The reaction can be conducted in the presence or absence of suitable solvents by (a) mixing all of the reactants together and heating, (b) by first reacting an aldehyde with the alcohol or the aromatic hydroxy compound, and then reacting the resultant intermediate with the thiadiazole, or (c) by reacting the aldehyde with thiadiazole first and the resulting intermediate with the hydroxy compound.

Another material useful as components in the compositions of the present invention is obtained by mixing a thiadiazole, preferably DMTD with an oil-soluble carboxylic dispersant in a diluent by heating the mixture above 100° C. This procedure, and the derivatives produced thereby are described in U.S. Pat. No. 4,136,043. The oil-soluble dispersants which are utilized in the reaction with the thiadiazoles are sometimes identified as "ashless dispersants," that is, not containing a metal ion, although it is to be understood that such dispersants may interact in a lubricant formulation with metal ions from other sources so that they are not actually metal free when in use. However, they are still to be considered under the name "ashless dispersant." Various types of suitable ashless dispersants useful in the reaction are described in the aforementioned U.S. Pat. No. 4,136,043 patent.

Certain preferred products for the thiadiazole-dispersant material for inclusion in the compositions of this invention include the products of DMTD with a nitrogen-containing polyester dispersant. The dispersant can be formed by reacting a polyisobutenyl succinic anhydride, pentaerythritol and polyethyleneamines, typically in the ratio of 1C═0:1.80H:0.26N, where C═O, OH, and N are carbonyl groups, hydroxy groups, and amine nitrogen groups. The dispersant is then reacted with DMTD. The polyisobutylene portion of the dispersant can have number average molecular weight of about 1000. Suitable dispersants include those which are described in greater detail below, as the dispersant component (d) of the present invention.

The amount DMTD and derivatives listed above can add sulfur in the amount of 0.0075–0.5 weight percent to the composition of this invention. Alternatively, the amount of DMTD or DMTD derivative can be an amount sufficient to prove 0.005 to 1 weight percent (or 0.01 to 0.5 percent, or 0.05 to 0.1 percent) of the

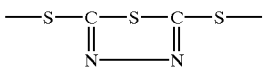

moiety in the lubricating composition.

A second component in the composition used in the present invention is a friction modifier. Friction modifiers are well known to those skilled in the art. A useful list of friction modifiers are included in U.S. Pat. No. 4,792,410. U.S. Pat. No. 5,110,488 discloses metal salts of fatty acids and especially zinc salts, useful as friction modifiers. A list of friction modifiers includes:

(i) fatty phosphites
(ii) fatty acid amides
(iii) fatty epoxides
(iv) borated fatty epoxides
(v) fatty amines
(vi) glycerol esters
(vii) borated glycerol esters
(viii) alkoxylated fatty amines
(ix) borated alkoxylated fatty amines
(x) metal salts of fatty acids
(xi) sulfurized olefins
(xii) fatty imidazolines
(xiii) condensation products of carboxylic acids and polyalkylene-polyamines
(xiv) metal salts of alkyl salicylates
(xv) amine salts of alkylphosphoric acids and mixtures thereof.

Representatives of each of these types of friction modifiers are known and are commercially available. For instance, (i) fatty phosphites are generally of the formula $(RO)_2PHO$. The preferred dialkyl phosphite, as shown in the preceding formula, is typically present with a minor amount of monoalkyl phosphite of the formula (RO)(HO)PHO. In these structures, the term "R" is conventionally referred to as an alkyl group. It is, of course, possible that the alkyl is actually alkenyl and thus the terms "alkyl" and "alkylated," as used herein, will embrace other than saturated alkyl groups within the phosphite. The phosphite should have sufficient hydrocarbyl groups to render the phosphite substantially oleophilic. Preferably the hydrocarbyl groups are substantially unbranched. Many suitable phosphites are available commercially and may be synthesized as described in U.S. Pat. No. 4,752,416.

It is preferred that the phosphite contain 8 to 24 carbon atoms in each of R groups. Preferably, the fatty phosphite contains 12 to 22 carbon atoms in each of the fatty radicals, most preferably 16 to 20 carbon atoms. In one embodiment the fatty phosphite is formed from oleyl groups, thus having 18 carbon atoms in each fatty radical.

(iv) Borated fatty epoxides are known from Canadian Patent No. 1,188,704. These oil-soluble boron containing compositions are prepared by reacting at a temperature from about 80° C. to about 250° C., at least one of boric acid or boron trioxide with at least one fatty epoxide having the formula

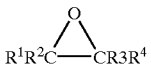

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation.

(iii) Non-borated fatty epoxides, corresponding to "Reagent B" above, are also useful as friction modifiers.

Borated amines are generally known from U.S. Pat. No. 4,622,158. Borated amine friction modifiers (including (ix) borated alkoxylated fatty amines) are conveniently prepared by the reaction of a boron compounds, as described above, with the corresponding amines. The amine can be a simple fatty amine or hydroxy containing tertiary amines.

The borated amines can be prepared by adding the boron reactant, as described above, to an amine reactant and heating the resulting mixture at a 50° to 300° C., preferably 100° C. to 250° C. or 150° C. to 230° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]cocoamine); ETHOMEEN™ C/20 (polyoxyethylene[10]cocoamine); ETHOMEEN™ S/12 (bis[2-hydroxyethyl]soyamine); ETHOMEEN™ T/12 (bis[2-hydroxyethyl]tallowamine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl] octadecylamine); and ETHOMEEN™ 18/25 (polyoxyethylene[15]octadecylamine). Fatty amines and ethoxylated fatty amines are also described in U.S. Pat. No. 4,741,848.

The (viii) alkoxylated fatty amines, and (v) fatty amines themselves (such as oleylamine) are generally useful as friction modifiers in this invention. Such amines are commercially available.

Both borated and unborated fatty acid esters of glycerol can be used as friction modifiers. The (vii) borated fatty acid esters of glycerol are prepared by borating a fatty acid ester of glycerol with boric acid with removal of the water of reaction. Preferably, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, or oil.

(vi) Fatty acid esters of glycerol themselves can be prepared by a variety of methods well known in the art. Many of these esters, such as glycerol monooleate and glycerol tallowate, are manufactured on a commercial scale. The esters useful are oil-soluble and are preferably prepared from $C_8$ to $C_{22}$ fatty acids or mixtures thereof such as are found in natural products and as are described in greater detail below. Fatty acid monoesters of glycerol are preferred, although, mixtures of mono and diesters may be used. For example, commercial glycerol monooleate may contain a mixture of 45% to 55% by weight monoester and 55% to 45% diester.

Fatty acids can be used in preparing the above glycerol esters; they can also be used in preparing their (x) metal salts, (ii) amides, and (xii) imidazolines, any of which can also be used as friction modifiers. Preferred fatty acids are those containing 6 to 24 carbon atoms, preferably 8 to 18. The acids can be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. A particularly preferred acid is oleic acid. Preferred metal salts include zinc and calcium salts. Examples are overbased calcium salts and basic oleic acid-zinc salt complexes which can be represented by the general formula $Zn_4Oleate_3O_1$. Preferred amides are those prepared by condensation with ammonia or with primary or secondary amines such as diethylamine and diethanolamine. Fatty imidazolines are the cyclic condensation product of an acid with a diamine or polyamine such as a polyethylenepolyamine. The imidazolines are generally represented by the structure

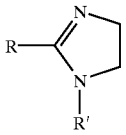

where R is an alkyl group and R' is hydrogen or a hydrocarbyl group or a substituted hydrocarbyl group, including —$(CH_2CH_2NH)_n$— groups. In a preferred embodiment the friction modifier is the condensation product of a $C_8$ to $C_{24}$ fatty acid with a polyalkylene polyamine, and in particular, the product of isostearic acid with tetraethylenepentamine. The condensation products of carboxylic acids and polyalkyleneamines (xiii) may generally be imidazolines or amides.

Sulfurized olefins (xi) are well known commercial materials used as friction modifiers. A particularly preferred sulfurized olefin is one which is prepared in accordance with the detailed teachings of U.S. Pat. Nos. 4,957,651 and 4,959,168. Described therein is a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol.

Reactant (3), the olefin component, comprises at least one olefin. This olefin is preferably an aliphatic olefin, which usually will contain 4 to 40 carbon atoms, preferably from 8 to 36 carbon atoms. Terminal olefins, or alpha-olefins, are preferred, especially those having from 12 to 20 carbon atoms. Mixtures of these olefins are commercially available, and such mixtures are contemplated for use in this invention.

The cosulfurized mixture of two or more of the reactants, is prepared by reacting the mixture of appropriate reactants with a source of sulfur. The mixture to be sulfurized can contain 10 to 90 parts of reactant (1), or 0.1 to 15 parts by weight of reactant (2); or 10 to 90 parts, often 15 to 60 parts, more often 25 to 35 parts by weight of reactant (3), or 10 to 90 parts by weight of reactant (4). The mixture, in the present invention, includes reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present invention include elemental sulfur, which is preferred, hydrogen sulfide, sulfur halide, sodium sulfide and a mixture of hydrogen sulfide and sulfur or sulfur dioxide. Typically often 0.5 to 3 moles of sulfur are employed per mole of olefinic bonds.

Metal salts of alkyl salicylates (xiv) include calcium and other salts of long chain (e.g. C12 to C16) alkyl-substituted salicylic acids.

Amine salts of alkylphosphoric acids (xv) include salts of oleyl and other long chain esters of phosphoric acid, with amines as described below; one useful type of amines in this regard is tertiary-aliphatic primary amines (Primene™).

The friction modifier is defined as "other than a species of (b)," because certain DMTD derivatives can also have friction modifying properties. The amount of the friction modifier is generally 0.1 to 1.5 percent by weight of the lubricating composition, preferably 0.2 to 1.0 or 0.25 to 0.75 percent.

The lubricant used in the present invention also will contain a dispersant. The dispersant is likewise described as "other than a species of (b)," because certain DMTD derivatives can also have dispersant properties, particularly those which are the reaction products with dispersants.

Many types of dispersants are known in the art. "Carboxylic dispersants," for one, are reaction products of carboxylic acylating agents (such as acids, anhydrides, esters) commonly containing at least about 34 and preferably at least about 54 carbon atoms, reacted with nitrogen-containing compounds (such as amines), organic hydroxy compounds (such aliphatic compounds including monohydric and polyhydric alcohols, or aromatic compounds including phenols and naphthols), nitrogen and hydroxy-containing materials, and/or basic inorganic materials. These reaction products include imide, amide, and ester reaction products of carboxylic acylating agents. Examples of these materials include succinimide dispersants and carboxylic ester dispersants.

The carboxylic acylating agents include alkyl succinic acids and anhydrides wherein the alkyl group is a polybutylene moiety. Other acylating agents include fatty acids of a variety of well known types. Carboxylic acylating agents are described in U.S. Pat. Nos. 2,444,328, 3,219,666 and 4,234,435.

The amine used in preparing a carboxylic dispersant can be any of the types described above, including mono- and polyamines. In one embodiment, the monoamines can have at least one hydrocarbyl group containing 1 to about 24 carbon atoms Examples of monoamines include fatty (C8–30) amines, primary ether amines (SURFAM™ amines), tertiary-aliphatic primary amines (Primene™), hydroxyamines (primary, secondary or tertiary alkanol amines), ether N-(hydroxyhydrocarbyl)amines, and hydroxyhydrocarbyl amines (Ethomeen™ and Propomeen™). Polyamines include alkoxylated diamines (Ethoduomeen™), fatty diamines (Duomeen™), alkylenepolyamines (ethylenepolyamines), hydroxy-containing polyamines, polyoxyalkylene polyamines (Jeffamine™), condensed polyamines (a condensation reaction between at least one hydroxy compound with at least one polyamine reactant containing at least one primary or secondary amino group), and heterocyclic polyamines. Useful amines include those disclosed in U.S. Pat. Nos. 4,234,435 and 5,230,714 the latter of which discloses in detail the preparation of condensed amines. In brief, the polyamine and hydroxy compound are reacted in the presence of an acid catalyst at elevated temperature. In an example, 201 g of tetraethylene pentamine is reacted with 151 g 40% aqueous tris (hydroxymethyl)aminomethane and 3.5 g 85% phosphoric acid upon heating in stages at 120 to 250° C., over a period of several hours.

Examples of "carboxylic dispersants" are described in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433.

Succinimide dispersants, a species of carboxylic dispersants, are prepared by the reaction of a hydrocarbyl-substituted succinic anhydride (or reactive equivalent thereof, such as an acid, acid halide, or ester) with an amine, as described above. The hydrocarbyl substituent group generally contains an average of at least 8, or 30, or 35 up to 350, or to 200, or to 100 carbon atoms. In one embodiment, the hydrocarbyl group is derived from a polyalkene. Such a polyalkene can be characterized by an $\overline{M}_n$ (number average molecular weight) of at least 500. Generally, the polyalkene is characterized by an $\overline{M}_n$ of 500, or 700, or 800, or 900 up to 5000, or to 2500, or to 2000, or to 1500. In another embodiment $\overline{M}_n$ varies from 500, or 700, or 800, to 1200 or 1300. In one embodiment the polydispersity ($\overline{M}_w/\overline{M}_n$) is at least 1.5.

The polyalkenes include homopolymers and interpolymers of polymerizable olefin monomers of 2 to 16 or to 6, or to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a polymer is a polybutene. In one instance about 50% of the polybutene is derived from isobutylene. The polyalkenes can be prepared by conventional procedures.

In one embodiment, the succinic acylating agents are prepared by reacting a polyalkene with an excess of maleic anhydride to provide substituted succinic acylating agents wherein the number of succinic groups for each equivalent weight of substituent group is at least 1.3, e.g., 1.5, or 1.7, or 1.8. The maximum number of succinic groups per substituent group generally will not exceed 4.5, or 2.5, or 2.1, or 2.0. The preparation and use of substituted succinic acylating agents wherein the substituent is derived from such polyolefins are described in U.S. Pat. No. 4,234,435.

The substituted succinic acylating agent can be reacted with an amine, including those amines described above and heavy amine products known as amine still bottoms. The amount of amine reacted with the acylating agent is typically an amount to provide a ratio of CO:N of 1:2 to 1: 0.75 in the resulting product. If the amine is a primary amine, complete condensation to the imide can occur. Varying amounts of amide product, such as the amidic acid, may also be present. If the reaction is, rather, with an alcohol, the resulting dispersant will be an ester dispersant. If both amine and alcohol functionality are present, whether in separate molecules or in the same molecule (as in the above-described condensed amines) mixtures of amide, ester, and possibly imide functionality can be present. These are the so-called ester-amide dispersants.

"Amine dispersants" are reaction products of relatively high molecular weight aliphatic or alicyclic halides and amines, preferably polyalkylene polyamines. Examples thereof are described in the following U.S. Pat. Nos. 3,275,554, 3,438,757, 3,454,555, and 3,565,804.

"Mannich dispersants" are the reaction products of alkyl phenols in which the alkyl group contains at least about 30 carbon atoms with aldehydes (especially formaldehyde) and amines (especially polyalkylene polyamines).

The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

Post-treated dispersants are also part of the present invention. They are generally obtained by reacting at carboxylic, amine or Mannich dispersants with reagents such as urea, thiourea, carbon disulfide, aldehydes, ketones, carboxylic acids, hydrocarbon-substituted succinic anhydrides, nitrites, epoxides, boron compounds (to give "borated dispersants"), or phosphorus compounds. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

The amount of dispersant used in the present invention is typically 1 to 10 percent by weight of the composition. Preferably it is 1.5 to 7 percent or 2 to 4 percent.

The composition used in the present invention can also include a variety of additional components. One component frequently used is a viscosity modifier. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers.

Examples of commercially available VMs, DVMs and their chemical types include the following: Polyisobutylenes (such as Indopol™ from BP Amoco or Parapol™ from ExxonMobil); Olefin copolymers (such as Lubrizol™ 7060, 7065, and 7067 from Lubrizol and Trilene™ CP-40 and CP-60 from Uniroyal); hydrogenated styrene-diene copolymers (such as Shellvis™ 40 and 50, from Shell and LZ® 7341, 7351, and 7441 from Lubrizol); Styrene/maleate copolymers, which are dispersant copolymers (such as LZ® 3702, 2751, and 3703 from Lubrizol); polymethacrylates, some of which have dispersant properties (such as those in the Acryloid™ and Viscoplex™ series from RohMax and the TLA™ series from Texaco); olefin-graft-polymethacrylate polymers (such as Viscoplex™ 2-500 and 2-600 from Rohm GmbH); and hydrogenated polyisoprene star polymers (such as Shellvis™ 200 and 260, from Shell). Recent summaries of viscosity modifiers can be found in U.S. Pat. Nos. 5,157,088, 5,256,752 and 5,395,539. The VMs and/or DVMs are incorporated into the fully-formulated compositions at a level of up to 15% by weight. Preferred amounts are 1 to 12% or 3 to 10%.

The compositions of the present invention can also include a detergent. Detergents as used herein are metal salts of organic acids. The organic acid portion of the detergent is a sulfonate, carboxylate, phenate, salicylate. The metal portion of the detergent is an alkali or alkaline earth metal. Preferred metals are sodium, calcium, potassium and magnesium. Typically, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should contain on average 10 to 40 carbon atoms, preferably 12 to 36 carbon atoms and preferably 14 tot 32 carbon atoms on average. Similarly, the phenates, salicylates, and carboxylates have a substantially oleophilic character.

While the present invention allows for the carbon atoms to be either aromatic or in paraffinic configuration, it is preferred that alkylated aromatics be employed. While naphthalene based materials may be employed, the aromatic of choice is the benzene moiety.

The most preferred composition is thus an overbased monosulfonated alkylated benzene, and is preferably the monoalkylated benzene. Alkyl benzene fractions can be obtained from still bottom sources and are mono- or di-alkylated. It is believed, in the present invention, that the mono-alkylated aromatics are superior to the dialkylated aromatics in overall properties.

It is desired that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant.

It is preferred that the salt be "overbased". By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Typically, the excess metal will be present over that which is required to neutralize the anion at about in the ratio of up to 30:1, preferably 5:1 to 18:1 on an equivalent basis.

The amount of the overbased salt utilized in the composition is typically 0.025 to 3 weight percent on an oil free basis, preferably 0.1 to 1.0 percent. The overbased salt is usually made up in about 50% oil with a TBN range of 10–600 on an oil free basis. Borated and non-borated overbased detergents are described in U.S. Pat. Nos. 5,403,501 and 4,792,410 which are herein incorporated by reference for disclosure pertinent hereto.

The compositions of the present invention can also include at least one phosphorus acid, phosphorus acid salt, phosphorus acid ester or derivative thereof including sulfur-containing analogs in the amount of 0.002–1.0 weight percent. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are dialkyphosphoric acid mono alkyl primary amine salts as represented by the formula

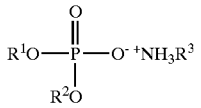

where $R^1$, $R^2$, $R^3$ are alkyl or hydrocarbyl groups. Compounds of this type are described in U.S. Pat. No. 5,354,484.

Eighty-five percent phosphoric acid is a preferred material for addition to the fully-formulated compositions and can be included at a level of 0.01–0.3 weight percent based on the weight of the composition, preferably 0.03 to 0.1 percent.

Other materials can optionally be included in the compositions of the present invention, provided that they are not incompatible with the aforementioned required components or specifications. Such materials include antioxidants (that is, oxidation inhibitors), including hindered phenolic antioxidants, secondary aromatic amine antioxidants, sulfurized phenolic antioxidants, oil-soluble copper compounds, phosphorus-containing antioxidants, organic sulfides, disulfides, and polysulfides. Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. These optional materials are known to those skilled in the art, are generally commercially available, and are described in greater detail in published European Patent Application 761,805. Also included can be corrosion inhibitors, dyes, fluidizing agents, odor masking agents, and antifoam agents.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 1

A composition is prepared by combining the following components: 100 parts by weight 90 Neutral API Group II oil;

- 0.11 parts dibutyl hydrogen phosphite
- 0.1 parts 85% phosphoric acid (aqueous)
- 1.0 part DMTD reaction product with a dispersant, which in turn is the condensation product of polyisobutenyl succinic anhydride with predominantly pentaerythritol and a lesser amount of polyethylenepolyamines; 51% active chemical; 49% oil.
- 0.6 parts alkylated diarylamine inhibitor
- 0.5 parts sulfur-containing antioxidant
- 0.03 parts thiadiazole inhibitor
- 0.2 parts borate ester friction modifier
- 0.26 parts additional diluent oil
- 0.4 parts heterocyclic seal swell agent
- 0.5 parts friction modifier comprising the condensation product of isostearic acid and tetraethylene pentamine.
- 4.0 parts dispersant prepared by reacting polyisobutene (m.w. about 1000)-substituted succinic anhydride with a condensed polyamine; CO:N ratio 1:1.3–1.6; 60% active chemical, 40% oil.
- 420 ppm antifoam agents
- 10.0 parts methacrylate copolymer viscosity index modifier
- 0.2 parts polymethacrylate pour point depressant
- 250 ppm red dye.

Example 2

A composition is prepared by combining the components as in Example 1, except that the 90 Neutral oil is replaced by 94.5 parts of a mixture of hydrogenated 1-decene homopolymers and 5.5 parts Priolube™ 87 ester; the methacrylate copolymer viscosity index modifier and the methacrylate pour point depressant are deleted.

Examples 3–6

A number of alternative formulations are prepared, comprising the following components (amounts are parts by weight on an oil-free basis):

| Example → Component, % | 3 | 4 | 5 | 6 |
|---|---|---|---|---|
| Base oil(s) | 4 cStPAO[a] | 4 cSt Group II | 3.8 cSt Group II | 95% Group II + 5% 2 cSt PAO |
| DMTD compound | DMTD treated esteramide, 0.5 | DMTD treated succinimide, 0.5 | DMTD treated esteramide, 1.0 | 2-hydro-carbyl-thio-5-mercapto-DMTD, 0.3 |

-continued

| Example → Component, % | 3 | 4 | 5 | 6 |
|---|---|---|---|---|
| Friction modifier | product of fatty acid + polyamine, 1.0 | dioloylphosphite, 0.2, + borated epoxide, 0.2 | overbased fatty acid salt, 0.2, + diethoxylated tallowamine, 0.2 | fatty amide, 0.2, + amine salt of alkyl phosphoric acid, 0.2 |
| Dispersant | succinimide, 4 | succinimide, 4 | succinimide, 4 | succinimide, 4 |
| Viscosity modifier | PMA[b], 3 | PMA, 12 | PMA, 12 | PMA, 12 |
| Phosphorus compound | dialkyl hydrogen phosphite, 0.2 | triphenylphosphite, 0.2 | diphenyl hydrogen phosphite, 0.5 | dialkyl hydrogen phosphite, 0.2 |
| Detergent | none | 300 TBN Ca overbased sulfonate, 0.05 | none | 200 TBN Ca overbased sulfurized phenate, 0.1 |
| Inhibitor | diaryl amine + sulfurtypes, 1 | hindered phenol + diaryl amine, 1 | diaryl amine, 1 | diarylamine + monosulfide type + hindered phenol, 1 |
| Others | none | phosphoric acid, 0.1 | borated dispersant, 0.5, + phosphoric acid, 0.03 | borated succinimide dispersant, 0.5, + phosphoric acid, 0.03 |

[a]. cSt = $mm^2$/sec. PAO = polyalpha olefin
[b]. PMA = methacrylate polymer.

The composition of Example 1 is subjected to a number of performance tests, with the results as shown in the following table. For reference, some test results from two selected manual transmission fluids ("MTF") are presented as Comparative Examples:

| | Example: | | |
|---|---|---|---|
| Test: | 1 | MTF 1 | MTF 2 |
| Friction Plate Anti-glazing Durability Test[a]: | | | |
| Dynamic Torque Fade | 10.6% (avg 3 runs) | 24.4% (avg 3 runs) | 30.2%[b] (avg 2 runs) |
| Static/Dynamic Ratio | 0.94 | 0.99 | 1.6 |
| Friction Plate Glazing | Light | Heavy | Heavy |
| Friction Plate Torque Durability Test[c]: | | | |
| Dynamic Torque Fade | 11.9% (5040 cycles) | 1.5% (5040 cycles) | 30.5% (1080 cycles) |
| Static/Dynamic Ratio | 1.05 | 1.05 | 1.6 |
| Metallic Synchronizer tests: | | | |
| Molybdenum Synchronizer Durability Test[d] (100,000 shift cycles) | Good: constant friction; low wear | —[e] | — |
| Brass Synchronizer Durability Test[f] (10,000 shift cycles) | Acceptable friction durability and torque | — | Acceptable friction durability and torque |

-continued

| | Example: | | |
|---|---|---|---|
| Test: | 1 | MTF 1 | MTF 2 |
| Wear | trace shape | | trace shape |
| FZG Pitting Test (PT-C/9/90) | Low wear No pitting at 324 hr. | — — | Low wear 300 hours |
| Ford Mercon V Wear Tests: | | | |
| ASTM D5182 FZG Gear Scuffing Test, 150° C. | 12 stage pass | 12 stage pass | — |
| ASTM D4172 4-Ball Wear, wear scar diameter (mm): | | | |
| 100° C. | 0.43 | — | — |
| 150° C. | 0.43 | — | — |
| ASTM D3233 Falex EP Wear, no seizure load (kg) | | | |
| 100° C. | 790 | — | — |
| 150° C. | 570 | — | — |
| ASTM D2782 (Modified) Timken Wear, burnish width, mm, 150° C. | 0.59 | — | — |
| Viscosity: ASTM D445 $mm^2/s$ (cSt) at 100° C.: | 7.4 | 7.18 | 7.25 |
| ASTM D2983 (Brookfield) −40° C., Pa-s (cP × $10^{-3}$) | 12.2 | 12.2 | 12.3 |

[a]. A composition friction material plate is tested against two steel reaction plates by repeated engagement under the following conditions: Oil temperature, 100° C.; Oil sump, 23 L (6 gal.); Pressure, 400 kPa; Engagement speed, 3300 rpm; Energy, 53 kJ.
[b]. Test run for 600 cycles
[c]. A composition friction material plate is tested against two steel reaction plates by engagement in an SAE No. 2 friction test machine under the following conditions: Oil temperature, 100° C.; Oil sump, 500 mL; Pressure, 300 kPa; Engagement speed, 3600 rpm; Energy, 48 kJ.
[d]. A synchromesh test is run in a synchronizer test rig using a molybdenum synchronizer for 100,000 cycles under the following conditions: Shifting force, 500 N; Differential speed, 1100 $min^{-1}$; Oil temperature, 80° C.; Oil flow, 1.5 L/min; Moment of inertia, 0.04 kg-$m^2$.
[e]. A dash (—) indicates that the test was not run.
[f]. A synchromesh test is run in a Hurth ™ synchronizer test rig using a brass synchronizer for 10,000 cycles under the following conditions: Oil temperature, 80° C.; Mass momentum, 0.06 kg-$m^2$; Time between shifts, 4 seconds.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined, as can ranges of different components. As used herein, the expression "consisting essentially of" permits the inclusion of substances which do not materially affect the basic and novel characteristics of the composition under consideration.

What is claimed is:

1. A method for lubricating a transmission having a plurality of wet clutches and a plurality of partial power transmission shafts, wherein shifting of gears occurs by a process comprising synchronization of an engaged and a non-engaged partial transmission shaft and engagement of a wet clutch; said method comprising supplying to said transmission a lubricating composition comprising:

(a) an oil of lubricating viscosity;

(b) 2,5-dimercapto-1,3,4-thiadiazole (DMTD), a derivative of DMTD, or mixtures thereof;

(c) a friction modifier other than a species of (b); and (d) a dispersant other than a species of (b).

2. The method of claim 1 wherein the oil of lubricating viscosity is a Group II or Group III oil or a synthetic oil or mixtures thereof.

3. The method of claim 1 wherein the amount of oil of lubricating viscosity is about 75 to about 95 weight percent.

4. The method of claim 1, wherein the friction modifier is selected from the group consisting of:

fatty phosphites fatty acid amides fatty epoxides borated fatty epoxides fatty amines glycerol esters borated glycerol esters alkoxylated fatty amines borated alkoxylated fatty amines metal salts of fatty acids sulfurized olefins fatty imidazolines condensation products of carboxylic acids and polyalkylenepoly amines metal salts of alkyl salicylates amine salts of alkylphosphoric acids and mixtures thereof.

5. The method of claim 1 wherein the friction modifier is a condensation product of a $C_6$ to $C_{24}$ aliphatic carboxylic acid and a polyalkylenepolyamine.

6. The method of claim 1 wherein the friction modifier is the condensation product of isostearic acid with tetraethylenepentamine.

7. The method of claim 1 wherein the amount of friction modifier is about 0.1 to about 1.5 percent by weight.

8. The method of claim 1 wherein the dispersant is selected from the group consisting of Mannich dispersants, succinimide dispersants, amine dispersants, ester dispersants, and ester/amide dispersants.

9. The method of claim 1 wherein the dispersant is a condensation product of a hydrocarbyl-substituted succinimide with a condensed amine.

10. The method of claim 1 wherein the dispersant is a borated dispersant.

11. The method of claim 1 wherein the amount of dispersant is about 1 to about 10 weight percent.

12. The method of 1, wherein said derivatives of DMTD are selected from the group consisting of:

2-hydrocarbyldithio-5-mercapto-1,3,4-thiadiazole or 2,5-bis-(hydrocarbyldithio)-1,3,4-thiadiazole, or mixtures thereof;

carboxylic esters of DMTD;

condensation products of α-halogenated aliphatic monocarboxylic acids with DMTD;

reaction products of unsaturated cyclic hydrocarbons and unsaturated ketones with DMTD;

reaction products of an aldehyde and diaryl amine with DMTD;

amine salts of DMTD;

dithiocarbamate derivatives of DMTD;

reaction products of an aldehyde and an alcohol or aromatic hydroxy compound and DMTD;

reaction products of an aldehyde and a mercaptan and DMTD;

2-hydrocarbylthio-5-mercapto-1,3,4-thiadiazole;

reaction product of an oil soluble dispersant with DMTD;

polymers of DMTD or any of the aforementioned derivatives of such polymers;

and mixtures thereof.

13. The method of claim 1 wherein the DMTD or DMTD derivative is the reaction product of a succinimide dispersant or a succinic ester/amide dispersant with a hydrocarbyl-substituted dimercaptothiadiazole.

14. The method of claim 1 wherein the amount of DMTD or DMTD derivative is about 0.02 to about 10 weight percent.

15. The method of claim 1 wherein the amount of DMTD or DMTD derivative is an amount sufficient to provide about 0.005 to about 1.0 weight percent of

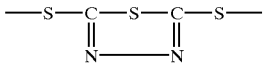

moiety in the lubricating composition.

16. The method of claim 1 wherein the lubricating composition further comprises a viscosity modifier.

17. The method of claim 1 wherein the lubricating composition further comprises an inorganic phosphorus acid.

18. The method of claim 1 wherein the lubricating composition further comprises a detergent.

19. The method of claim 1 wherein the lubricating composition is a composition prepared by admixing the components set forth therein.

20. A composition suitable for lubricating a transmission having a plurality of wet clutches and a plurality of partial power transmission shafts, comprising or prepared by mixing:

(a) an oil of lubricating viscosity;

(b) a reaction product of 2,5-dimercapto-1,3,4-thiadiazole and a nitrogen-containing dispersant;

(c) a friction modifier which is a condensation product of a $C_8$ to $C_{24}$ fatty acid and a polyalkylenepolyamine; and (d) a phosphorus compound.

21. The composition of claim 20 wherein the phosphorus compound comprises an inorganic phosphorus acid or a dialkylhydrogen phosphite or both.

22. The composition of claim 20 further comprising a borated dispersant, other than a species of (b).

* * * * *